United States Patent [19]

Nihyakumen et al.

[11] 3,950,171

[45] Apr. 13, 1976

[54] DIAZOTYPE MULTICOLOR REPRODUCTION PROCESS

[75] Inventors: Kouzi Nihyakumen, Hirakata; Yasui Ueda, Kobe; Yasutoki Kamezawa, Hirakata; Tatsuo Aizawa, Kuwatsu, all of Japan

[73] Assignee: Mita Industrial Co. Ltd., Osaka, Japan

[22] Filed: Apr. 24, 1974

[21] Appl. No.: 463,593

Related U.S. Application Data

[63] Continuation-in-part of Ser. No. 166,044, July 26, 1971, abandoned.

[30] Foreign Application Priority Data

July 27, 1970 Japan ..... 45-65167

[52] U.S. Cl. ..... 96/49; 96/75.85

[51] Int. Cl.[2] ..... G03C 5/34; G03C 5/18

[58] Field of Search ..... 96/91 R, 75, 49.85

[56] References Cited

UNITED STATES PATENTS

| | | | |
|---|---|---|---|
| 3,352,677 | 11/1967 | Kosalek | 96/75 |
| 3,454,764 | 7/1969 | Collier et al. | 96/49 |
| 3,715,213 | 2/1973 | Nihyakumen et al. | 96/49 |
| 3,725,066 | 4/1973 | Kihyakumen et al. | 96/49 |
| 3,820,996 | 6/1974 | Nihyakumen et al. | 96/49 |
| 3,824,101 | 7/1974 | Nihyakumen et al. | 96/49 |

FOREIGN PATENTS OR APPLICATIONS

| | | | |
|---|---|---|---|
| 966,258 | 8/1964 | United Kingdom | 96/75 |
| 1,000,151 | 8/1965 | United Kingdom | 96/49 |
| 1,128,837 | 10/1968 | United Kingdom | 96/75 |
| 1,129,407 | 10/1968 | United Kingdom | 96/75 |
| 1,169,227 | 10/1969 | United Kingdom | 96/75 |
| 1,268,666 | 3/1972 | United Kingdom | 96/75 |

OTHER PUBLICATIONS

Kosov, J., "Light-Sensitive System," Wiley & Sons, 1965, pp. 296–300.

*Primary Examiner*—Charles L. Bowers, Jr.
*Attorney, Agent, or Firm*—Sherman & Shalloway

[57] ABSTRACT

This invention relates to a process for diazotype multicolor reproduction using an improved photosensitive material having a continuous thermoplastic resin precoated layer.

8 Claims, 4 Drawing Figures

DIAZOTYPE MULTICOLOR REPRODUCTION PROCESS

CROSS-REFERENCE TO RELATED APPLICATION

This application is a continuation-in-part application of our copending application, Ser. No. 166,044, filed July 26, 1971 now abandoned.

BACKGROUND OF THE INVENTION

1. Field of the Invention

This invention relates to an improved process for diazo-type multicolor reproduction. More particularly, the invention relates to a process for diazotype multicolor reproduction using a photosensitive material having a continuous thermoplastic resin pre-coated layer.

2. Description of the Prior Art

It has heretofore been known that when two or more diazonium salts which have different resolving rates and exhibit different hues upon bonding with couplers are used in diazotype reproduction, reproductive copies can be obtained which are colored in two or more hues, depending on the intensity of light on the exposed portions. In such reproductive copies, image colors of the semi-exposed portions are mingled with image colors of non-exposed portions to form a compound color, and the color contrast in the image becomes faded. In such a known reproduction process, it is impossible to reproduce an original having a similar image concentration or light transmission throughout the entire original into different hues.

No diazotype reproduction process has been known by which predetermined portions of an original can be reproduced into hues different from one another regardless of difference or similarity of the light transmission in the original.

In U.S. Pat. No. 3,715,213, a process was suggested for multi-color reproduction, which comprises A. exposing image-wise a diazotype photosensitive material at actinic light by exposing through an original sheet of an assembly, said assembly consisting of (*i*) an original sheet having opaque image areas and transparent non-image areas and a layer containing at least one thermovolatile or sublimable azo coupler (*a*), said layer being on one surface of said original sheet, and coupler (*a*) being located in only preselected areas which are contiguous with opaque image areas of said original sheet, said preselected areas being present in only a portion of the areas contiguous with said opaque image areas of said original sheet, and (*ii*) a diazotype photosensitive material having a photosensitive layer containing at least one photosensitive diazonium salt (*c*), said original sheet (*i*) being superposed on said diazotype photosensitive material (*ii*) so that the layer of the azo coupler (*a* ) comes into face-to-face contact with the photosensitive layer;

B. heating said assembly to thereby heat-transfer said layer of the coupler (*a*) to the corresponding position on the surface of said photosensitive layer, said steps (A) and (B) being performed simultaneously or in the time sequence of (A) to (B) or (B) to (A); and C. developing the exposed photosensitive material with an alkali developer in the presence of an azo coupler (*b*) having a substantially lower rate of coupling with the diazonium salt (*c*) under the developing conditions than that of the azo coupler (*a*), to thereby develop said photosensititve material, whereby in the unexposed latent image area of the portion to which the coupler (*a*) has been heat-transferred, a dye (*c*)–(*a*) having a certain hue or color is formed by the selective reaction of the heat-transferred coupler (*a*) with the diazonium salt (*c*) and at the same time, in the unexposed latent image areas to which the coupler (*a*) has not been heat-transferred, a dye (*c*)–(*b*) having a different hue or color from said dye (*c*)–(*a*) is formed by the reaction of the coupler (*b*) with the diazonium salt (*c*), thus producing a multicolored copied image.

Photosensitive materials for diazotype reproduction are usually prepared by coating on a base paper an aqueous solution of a photosensitive diazonium salt optionally containing other additives such as a coupler and a stabilizer. In such copying sheets for diazotype reproduction, the photosensitive composition penetrates into voids of the base paper and even the interior of the base paper is impregnated with the photosensitive composition. Accordingly, a great quantity of the photosensitive composition is required and, moreover, there is a tendency that the contrast in the reproductive copy and the sensitivity of the photosensitive material are lowered.

In order to overcome the above defect, it is common in the art to pre-coat the base paper with an inorganic filler such as silica gel, alumina, titanium oxide and clay, e.g. kaolin, or a combination of such inorganic filler with a high molecule material such as starch, casein, polyvinyl alcohol and polyvinyl acetate emulsion, and to coat a photosensitive composition on the resulting precoat layer. In the art, it is generally known that, in order for the photosensitive composition to be supported on the precoat layer of the base paper, the void-filling precoat layer should be a discontinuous layer of particles. For instance, in Tappi, 48, 55A–59A, Aug. (1965), the following teaching is given:

> "The first conception of the precoat principle, i.e., a discontinuous layer of fine particles deposited on the paper surface, is still the basis of the precoating technique" (column 1, page 57A).

Further, in U.S. Pat. No. 3,352,677, there is disclosed a light-sensitive diazotype material for use as diazo intermediate paper, the light-sensitive diazotype material being obtained by impregnating a paper base with a solution of a resin such as polystyrene, polypropylene, etc., in an organic solvent such as toluene, xylene, etc., followed by applying to one surface an aqueous light-sensitive diazotype compound solution.

Moreover, British Pat. No. 1,169,227 discloses a paper sheet having a lacquer coating of a cross-linked hydroxpropyl cellulose ether or a cross-linked hydroxypropyl methyl cellulose ether which can be used as the paper base of a copying sheet. However, by application of the above photosensitive materials having a discontinuous resin pre-coated layer and photosensitive materials disclosed in U.S. Pat. No. 3,352,677 and British Pat. No. 1,169,227 to said multi-color reproduction process, color mixing of the resulting colored image tends to occur (i.e., a turbidly colored image easily forms). In addition, there is the disadvantage of it being difficult to obtain multi-colored copies which may sufficiently satisfy reproduction properties such as concentration, contrast and clearness of the resulting reproductive image.

SUMMARY OF THE INVENTION

It has been discovered that when a photosensitive material possessing a continuous pre-coating layer which consists of a high molecule material is used as the photosensitive material in accordance with the above process for diazotype multi-color reproduction, there may be prepared multi-colored reproductive copies having a colored image freed from color mixing.

This is because there is an outstanding difference in acceptance capacity (heat-transfer capacity) of the thermovolatile or sublimable coupler (*a*) heat-transferred to the surface of the photosensitive layer depending on the kind of high molecular materials forming said continuous pre-coating layer. It appears that only a photosensitive material possessing a continuous pre-coating layer of certain specific thermoplastic resins (i.e., the photosensitive material) which have a continuous thermoplastic resin layer between a base paper and a photosensitive layer, containing at least one photosensitive diazonium salt, in which said thermoplastic resin is selected from the group consisting of polyvinyl acetate, polyacrylic acid ester, polyvinyl chloride, polyvinylidene chloride, polystyrene, ethylene/vinyl acetate copolymer, styrene-butadiene copolymer and vinyl acetate/acrylic acid copolymer, will provide a multi-colored reproductive copy having a multi-colored copied image which is clear, high in contrast and has a very high concentration.

The present invention is an improvement in a process for diazotype multi-color reproduction, which process comprises:

A. exposing image-wise to actinic light a diazotype photosensitive material having a photosensitive layer containing at least one photosensitive diazonium salt (*c*) through an original sheet having opaque image areas and transparent or semi-transparent, non-image areas; and B. heating a layer containing at least one thermovolatile or sublimable azo coupler (*a*), which is disposed in face-to-face contact with the photosensitive layer of said photosensitive material, at a preselected area corresponding to an opaque image area of the original sheet desired to be reproduced in a different hue, to thereby heat-transfer said layer of the azo coupler (*a*) to the corresponding position on the surface of said photosensitive layer;

said steps (A) and (B) being performed simultaneously or in the time sequence of (A) to (B) or (B) to (A); and C. developing the exposed photosensitive material in the presence of an azo coupler (*b*) having a substantially low rate of coupling with the diazonium salt (*c*) under the developing condition of that of the azo coupler (*a*), to thereby develop said photosensitive material, whereby in the unexposed latent image area of the portion to which the coupler (*a*) has been heat-transferred, a dye (*c*)–(*a*) having a certain hue or color is formed by the selective reaction of the heat-transferred coupler (*a*) with the diazonium salt (*c*) and at the same time, in the unexposed latent image areas to which the coupler (*a*) has not been heat-transferred, a dye (*c*)–(*b*) having a different hue or color from said dye (*c*)–(*a*) is formed by the reaction of the coupler (*b*) with the diazonium salt (*c*), thus producing a multi-colored copied image.

The improvement of this invention comprises using, as said diazotype photosensitive material, that which has a continuous thermoplastic resin layer between a base paper and a photosensitive layer containing at least one photosensitive diazonium salt, in which said thermoplastic resin is selected from the group consisting of polyvinyl acetate, polyacrylic acid ester, polyvinyl chloride, polyvinylidene chloride, polystyrene, ethylene/vinyl acetate copolymer, styrene/butadiene copolymer and vinyl acetate/acrylic acid copolymer. In accordance with the above improved process for multi-color reproduction, there may be prepared easily and in plurality multi-colored reproductive copies having a colored image which experiences no color mixing, displays a high contrast and has a very high concentration.

BRIEF DESCRIPTION OF THE DRAWINGS

In FIG. 1, different thermovolatile or sublimable couplers 2' and 3' are coated on the back surface of opaque images 2 and 3, respectively, of an original having images, 1, 2 and 3. When the so formed original for multi-color development is superimposed on a photosensitive paper, formed from a base paper, continuous thermoplastic resin layer and photosensitive layer and exposed to light emitted from a suitable light source, latent images 1'', 2'' and 3'' corresponding to images 1, 2 and 3 are formed on the photosensitive layer of the photosensitive paper and couplers 2' and 3' are transferred on the upper surface of the photosensitive layer. When the above photosensitive sheet is developed, the diazonium salt in latent images 2'' and 3'' of the photosensitive layer is selectively reacted with transferred couplers 2' and 3', while the diazonium salt in latent image 1'' is reacted with a coupler contained in the photosensitive layer. Thus, a reproductive copy which has images 11, 12 and 13 colored in different hues is obtained.

FIG. 2 is a view illustrating an embodiment similar to the above embodiment shown in FIG. 1 except that a heat transferable sheet containing thermovolatile or sublimable coupler 2' and a different heat transferable sheet containing thermovolatile or sublimable coupler 3' are applied to the back surfaces of opaque images 2 and 3, respectively, of an original having opaque images 1, 2 and 3.

FIG. 3 illustrates another embodiment of the multi-color reproduction process where an original having an opaque image area 2 on one surface and opaque image areas 1 and 3 on the opposite surface is used as the original. Different thermovolatile or sublimable couplers 2' and 3' are coated on said opposite surface of the original at the portion contiguous with the image 2 and on the surface of the image 3, and then the light exposure, heat transfer and development are conducted by procedures as described by reference to the embodiment of FIG. 1, whereby a multi-color copy which has images 11, 12 and 13 colored in different hues can be obtained.

DESCRIPTION OF THE PREFERRED EMBODIMENTS

Figure 1:
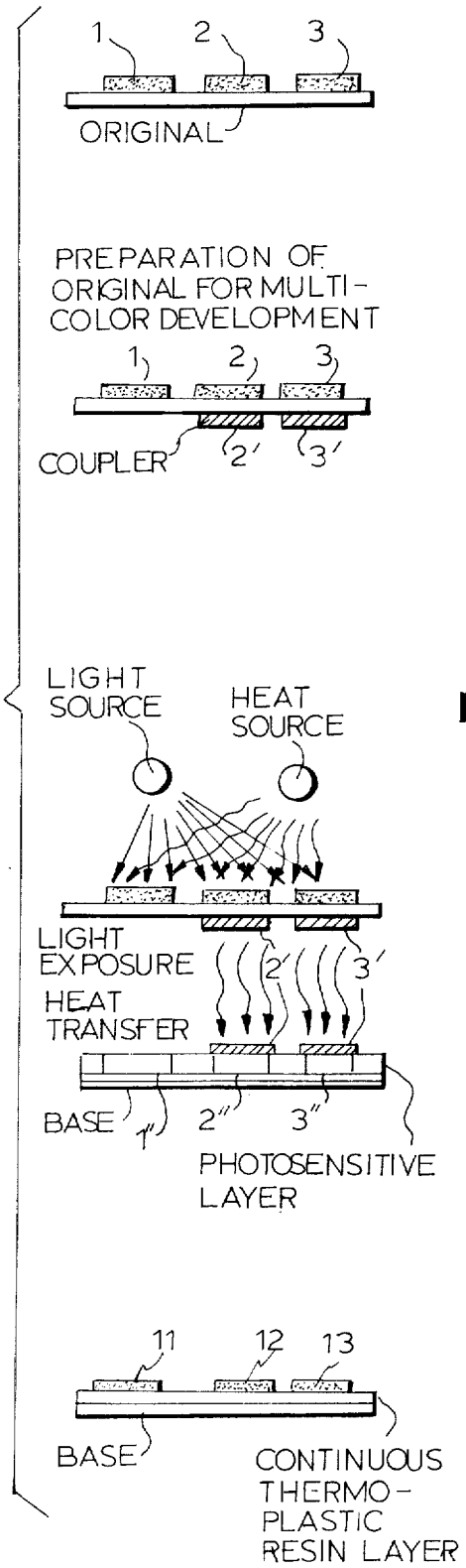
FIGS. 1 to 3 explain the principles of light exposure, heat transfer and development.
Figure 2:
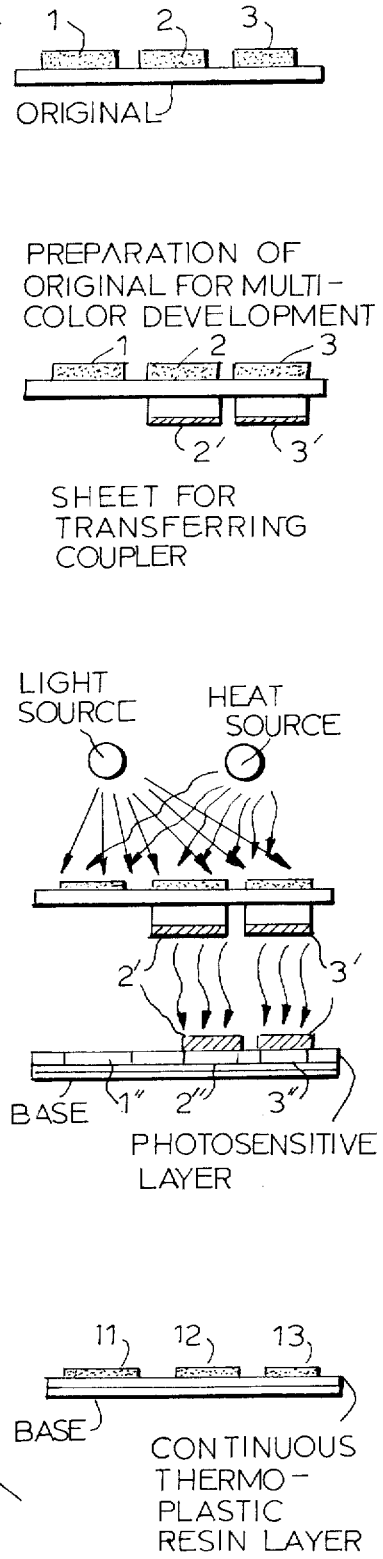
Figure 3:
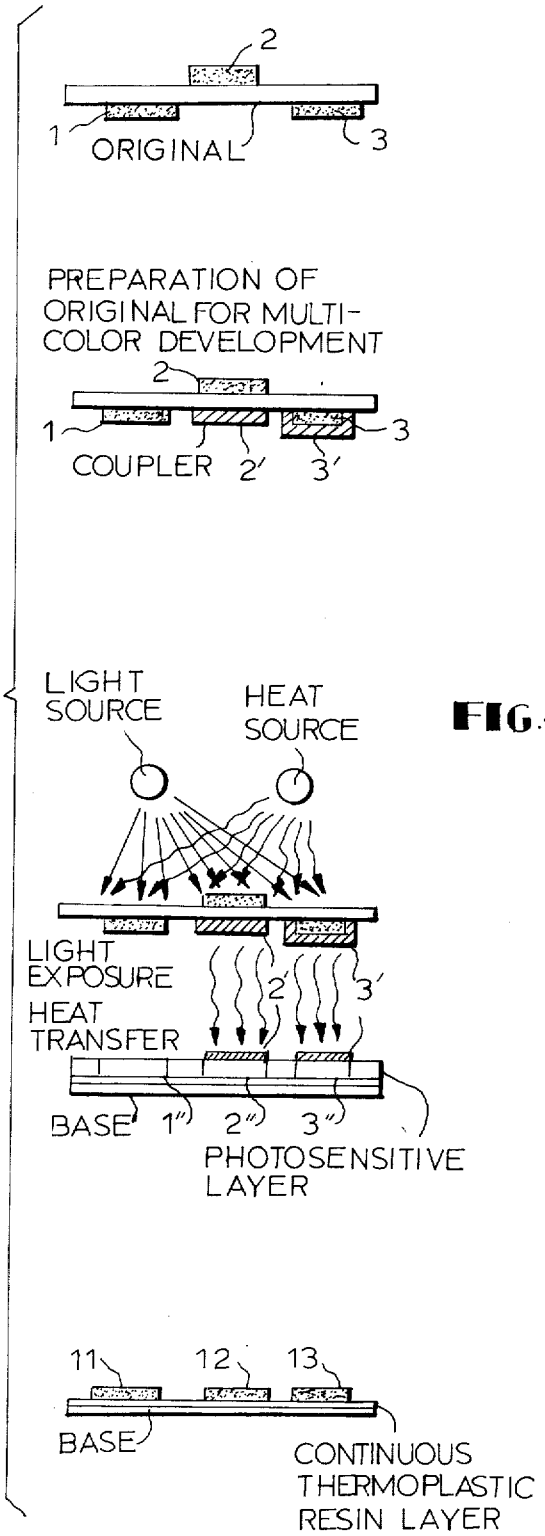
Figure 4:
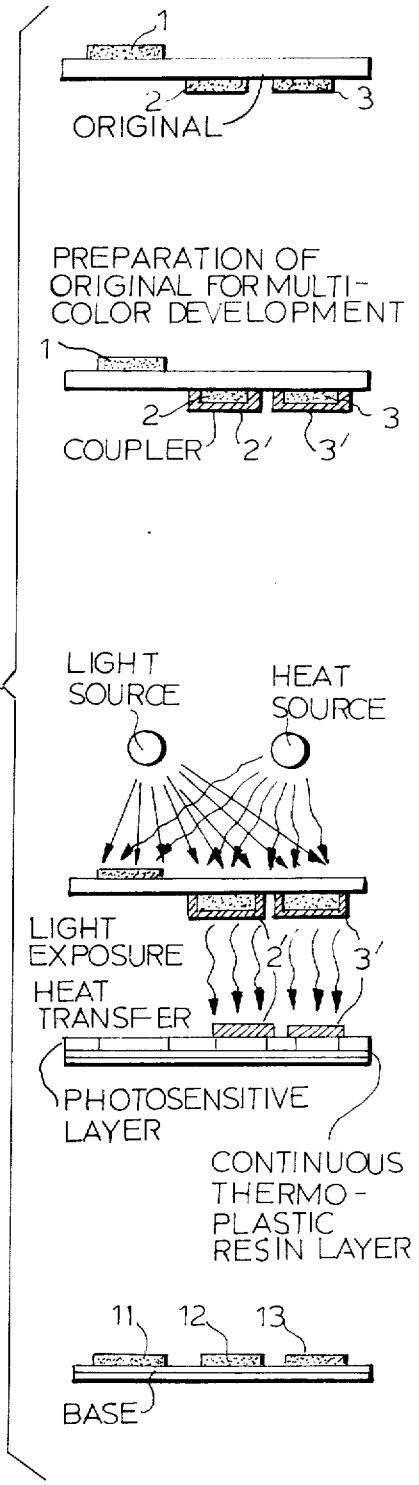
FIG. 4 illustrates still another embodiment of the multi-color reproduction process where an original having an opaque image 1 on one surface and opaque images 2 and 3 on the opposite surface is used as the original. Different thermovolatile or sublimable couplers 2' and 3' are coated on the surface of images present on said opposite surface, and the light exposure, heat transfer and development are carried out by procedures as described by reference to the embodiment of FIG. 1, whereby a multi-color copy which has images 11, 12 and 13 colored in different hues can be obtained.

In this invention, as a base paper, there may be used an ordinary paper composed of cellulose fibers, such as base paper for a copying sheet, high quality paper, mean quality paper and newsprint. In addition, synthetic papers made from synthetic fibers of polyvinyl alcohol or other polymers and synthetic papers formed by subjecting synthetic resin films to foaming or matting treatments may be used as a base paper.

According to the invention, a continuous thermoplastic resin pre-coating layer is formed on at least one surface of a base paper. That is, this continuous layer of a thermoplastic resin may be formed on either one or both surfaces of the base paper. Further, it is also possible to impregnate the entire base paper with a thermoplastic resin. In short, it is important that a layer of a thermoplastic resin coats completely and continuously at least one surface of the base paper.

Furthermore, in the present invention, it is important and critical to employ the following resins as the thermoplastic resin to form a continuous pre-coating layer: polyvinyl acetate, polyacrylic acid ester, polyvinyl chloride, polyvinylidene chloride, polystyrene, ethylene/vinyl acetate copolymer, styrene/butadiene copolymer, and vinyl acetate/acrylic acid copolymer.

The above resins may be used separately or in combination. Preferred, in particular, are polyvinyl acetate, polyvinyl chloride and styrene/butadiene copolymer. In addition, the resin's polymerization degree and copolymerization ratio may be altered in an optional range so long as they retain their film-forming power.

The above resins are capable of forming a continuous pre-coating layer by applying them to the surface of the base paper in the form of an organic solvent solution or an emulsion.

In case a solution in which the thermoplastic resin is homogeneously dissolved is used, a continuous coating may be directly formed only by coating the solution on the base paper. Drying may be either partial or complete.

When the thermoplastic resin is applied in an emulsion form, an aqueous emulsion is preferred. However, when employing an aqueous emulsion of the thermoplastic resin, since the applied coating is not continuous, the coated base paper is heated at a temperature exceeding the softening point of the applied resin to make the coating continuous. When a solvent or plasticizer for the resin is added to the aqueous emulsion in advance or is applied on the discontinuous coating prior to the heating, it is possible to lower the temperature of the heating.

Whether the resin layer coated on the paper substrate is continuous or not may be readily determined by applying water on the coated layer after it has been completely dried. If the coating layer is continuous, it exhibits a water-repellent property uniformly throughout the surface.

The amount of the thermoplastic resin applied on the base paper varies to some extent depending on the kind of the base paper and the kind of the resin to be applied, but, in general, it is applied in an amount of 1.0 – 30 g, preferably 2 – 10 g, per square meter of the base paper.

On the continuous pre-coating layer there is applied a diazotype photosensitive coating composition containing at least one photosensitive diazonium salt (*c*). The formation of said photosensitive coating composition can be rendered nearly identical with that of an ordinary diazotype photosensitive material, provided that a non-ionic or cationic surfactant, an organic binder such as polyvinyl acetate, polyvinyl alcohol, dextrin, starch or the like, or a plasticizer like dioctyl phthalate or dibutyl phthalate is optionally contained therein to facilitate the application.

Moreover, when the thermoplastic resin forming a precoating layer is soluble or swelling in an organic solvent, a dispersion medium of said photosensitive composition may be partially or wholly replaced by said organic solvent, preferably a watermiscible organic solvent, such as alcohols, ketones, e.g., methyl ethyl ketone and acetone, ester, e.g., ethyl acetate mixtures of alcohols with aromatic hydrocarbons, e.g., xylene.

In order to improve the image concentration of the resulting reproduction and to facilitate application of said composition onto the continuous pre-coating layer of the thermoplastic resin, it is also desirable to add to said photosensitive composition a white, solid powder, which may be inorganic, such as colloidal silica, titanium dioxide, zinc oxide or alumina, or which may be organic, such as starch, dextrin, or cellulose. Such white, solid powder may be used in amounts from 0.5 to 3 grams, and preferably from 0.6 to 1.5 grams per square meter in a photosensitive layer resulting from said composition.

By the use of a base paper possessing a continuous thermoplastic resin pre-coating layer in accordance with the present process, it is possible to make the photosensitive layer relatively thinner than the prior art diazotype photosensitive material. For example, the layer may be as thin as 2–15$\mu$, and particularly as thin as 5–10$\mu$.

It is most preferred that the photosensitive coating composition be applied in the form of an aqueous solution or an aqueous dispersion.

Examples of such photosensitive coating compositions are as follows:

A. Two-component Type Photosensitive Composition For Dry Development

| | |
|---|---|
| Diazonium salt (c) | 0.2 – 5.0 % by weight |
| Organic acid | 0.1 – 10.0% by weight |
| Azo coupler (b) | 0.2 – 5.0 % by weight |
| White solid powder | 0.2 – 30.0% by weight |
| Binder | 0 – 10.0% by weight |
| Surface active agent | 0 – 3.0 % by weight |
| Dispersion medium | balance |

B. Two-component Type Photosensitive Composition For Wet Development

| | |
|---|---|
| Diazonium salt (c) | 0.2 – 5.0 % by weight |
| Organic acid | 0.1 – 5.0 % by weight |
| Azo coupler (b) | 0.2 – 5.0 % by weight |
| White solid powder | 0.2 – 30.0% by weight |
| Binder | 0 – 10.0% by weight |
| Stabilizer | 0 – 5.0 % by weight |
| Coloring material | 0.001 – 0.025% by weight |
| Dispersion medium | balance |

C. One-component Type Photosensitive Composition For Wet Development

| | |
|---|---|
| Diazonium salt (c) | 0.2 – 5.0 % by weight |
| Organic acid | 0.1 – 7.0 % by weight |
| White solid powder | 0.2 – 30.0% by weight |
| Binder | 0 – 10.0% by weight |
| Surface active agent | 0 – 3.0 % by weight |
| Dispersion medium | balance |

D. Photosensitive Composition For Heat Development

| | |
|---|---|
| Diazonium salt (c) | 0.2 – 5.0 % by weight |
| Azo coupler (b) | 0.2 – 5.0 % by weight |
| Thermodecomposable organic acid | 4.0 – 10.0% by weight |
| Alkali-forming agent | 2.0 – 10.0% by weight |
| White solid powder | 0.2 – 30.0% by weight |

-continued

A. Two-component Type Photosensitive Composition For Dry Development

| | |
|---|---|
| Binder | 0 - 10.0% by weight |
| Surface active agent | 0 - 3.0 % by weight |
| Dispersion medium | balance |

The azo coupler (*b*) is advantageous in that it is present in the above two-component type photosensitive composition or photosensitive composition for heat development in quantities of not greater than 1 mole per mole of the diazonium salt (*c*), especially ranging from 0.2 to 0.9 mole per mole of the diazonium salt (*c*).

Further, an organic acid may be contained in the above photosensitive composition in amounts of at least 5 moles per mole of the diazonium salt (*c*), more preferably from 8 to 15 moles per mole of the diazonium salt (*c*).

The photosensitive composition of the above formula is coated on a continuous pre-coating layer of a base paper, and dried to form a photosensitive material.

Any diazonium compound that is capable of being coupled with the above-mentioned couplers (*a*) and (*b*) under ordinary developing conditions may be used as the diazonium compound (*c*) in this invention. Examples of such diazonium compounds are as follows:

Para-phenylene-diamine-N,N-substituted compounds of the following general formula:

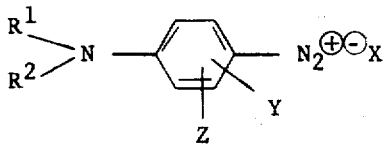

wherein X stands for an anion, $R^1$ and $R^2$ each are aliphatic hydrocarbon groups, and Z and Y denote substituents which can be introduced into the benzene nucleus.

Specific examples of the compounds of this type are as follows:

4-Diazo-N,N-dimethyl aniline
(referred to simply as "MA salt")
4-Diazo-N,N-diethyl aniline
(referred to simply as "EA salt")
4-Diazo-N-ethyl-N-β-hydroxyethyl aniline
(referred to simply as "EH salt")
4-Diazo-N,N-bis-β-hydroxyethyl aniline
4-Diazo-N-methyl-N-β-hydroxyethyl aniline
4-Diazo-N-ethyl-N-β-hydroxypropyl aniline
Other diazonium salts of p-phenylene diamines N,N-substituted with alkyl or hydroxy-alkyl groups
4-Diazo-N-ethyl-N-(β-diethylamino)-ethyl aniline
4-Diazo-2-chloro-N,N-diethyl aniline
4-Diazo2-methyl-N,N-diethyl aniline
4-Diazo-2-iodo-N,N-diethyl aniline
4-Diazo-2-trifluoromethyl-N,N-diethyl aniline
4-Diazo-N-ethyl-N-benzyl aniline
4-Diazo-N-methyl-N-benzyl aniline
(referred to simply as "methyl benzyl")

Aminohydroquinone ether-type compounds of the following general formula:

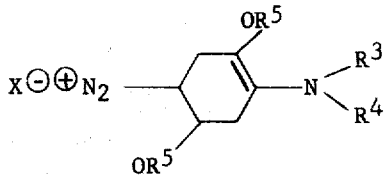

wherein $R^3$, $R^4$ and $R^5$ are alkyl or aryl groups and X stands for an anion.

Specific examples of the compounds of the above type are as follows:

4-Diazo-2,5-dibutoxy-N,N-diethyl aniline
4-Diazo-2,5-diethoxy-N-benzoyl aniline
(referred to simply as "BB salt")
4-Diazo-2,5 -diethoxy-N-ethyl-N-benzoyl aniline
4-Diazo-2,5-dibenzyloxy-N-benzoyl aniline
4-Diazo-2-chloro-5-methoxy-N-benzoyl aniline
4-Diazo-2,5-diethoxy-N-benzoyl-methyl aniline
4-Diazo-2,5-diethoxy-N-benzoyloxy-methyl aniline
Other 4-diazo-2,5-dioxyalkyl (or dioxyaryl)-N-alkyl (or aryl) compounds and derivaties thereof Aminodiphenyl compounds, aminodiphenyl amine compounds and their analogues of the following general formulas:

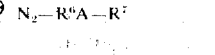

and

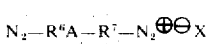

wherein X is an anion, $R^6$ is a divalent aryl group, $R^7$ is a monovalent or divalent aryl or alkyl group, A is a divalent group or a direct bond and examples of the $R^6$—A—$R^7$ are diarylamine (A; —NH—), diphenyl (A; direct bond), diphenyl oxide (A; —O—), diaryl methane (A; $—CH_2—$), stilbene (A; —CH=CH—) and diaryl or dialkyl sulfide (A; —S—).

Specific examples of the compounds of the above type are as follows:

Para-diazophenyl amine
4-Diazo-2,5,4′-triethoxydiphenyl amine
4-Diazo-2,5,4′-triethoxydiphenyl
4,4′-Bis-diazo-2,2′, 5,5′-tetrahydroxyphenyl methane
Bis-diazo-8,8′-dichloro-5,5′-dimethoxy benzidine
4-Diazo-2,5-dimethoxyphenylethyl sulfide
4-Diazo-2,5-diethoxy-4′-methyl-diphenyl sulfide Heterocyclic amine derivatives of the following general formula:

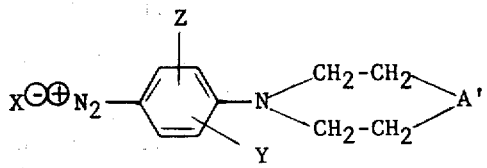

wherein X stands for an anion, Y and Z are substituents which can be introduced into the benzene nucleus, and A′ is a direct bond or a divalent group such as —O—, —S— and methylene.

Specific examples of the compounds of this type are as follows:

4-Diazo-2,5-dibutoxy-N-phenyl morpholine
4-Diazo-2,5-diethoxy-N-phenyl morpholine
4-Diazo-2-methoxy-N-thio morpholine
4Diazo-N-phenyl piperidine 4-Diazo-N-phenyl pyrrolidine
4-Diazo-2,5-di-N-butoxy-N-phenyl piperidine
Other derivatives of 4-Diazo-N-phenyl heterocyclic amines.
N,N-Substituted ortho-phenylene diamine derivatives and ortho-amino-phenol derivatives.

Specific examples of the compounds of this type are as follows:

2-Diazo-4-methylmercapto-N,N'-dimethyl aniline
2-Diazo-5-benzoylamino-N,N'-dimethyl aniline
2-Diazo-1-naphthol-5-sulfonic acid The above-mentioned diazonium compounds may be used in the form of a relatively stable salt with sulfuric acid or hydrochloric acid. They may also be used in the form of a double salt with zinc chloride, tin chloride, aluminum sulfate or the like. Further, they may be stabilized by an aryl sulfonate (in the form of a diazonium salt of an aromatic sulfonic acid), a diazosulfonate or the like.

It is essential that, among the thermovolatile or sublimable coupler (*a*), coupler (*b*) and diazonium salt (*c*) used in the process for multi-color reproduction mentioned hereinbefore, there should be established the following relations:

I. Thermovolatile or sublimable coupler (*a*) has a higher coupling rate under developing conditions than coupler (*b*).

II. Dyestuff (*b*)—(*c*), dyestuff (*a*)—(*c*); dyestuff (*a'*λ)-(*c*) . . . formed at the development have hues different from one another.

Any coupler that can be volatilized or sublimated by heating and be coupled with a photosensitive diazonium salt (*c*) may be used as the thermovolatile or sublimable coupler (*a*). As such coupler (*a*), phenol derivatives, hydroxynaphthalene derivatives, aniline derivatives and active methylene group-containing compounds may be mentioned. They may be used singly, or two or more of them may be used in combination. It is generally preferred that these derivatives do not contain soluble groups such as a sulfonic acid group for the purpose of facilitating the heat transfer operation.

Examples of these derivatives usable as coupler (*a*) are as follows:

Phenol Derivatives

Phenol
Pyrocatechol
Resorcinol
Phloroglycinol
o-Hydroxybenzalcohol
Resorcin monoglycol ether
Resorcin glycol ether
Hydrotoluquinone
Pyrogallol-4-carboxylic acid
Vanillin
Isovanillic acid
Vanillic acid
Meta-aminobenzoic acid
5-hydroxy-isophthalic acid
2-Hydroxy-terephthalic acid
2-Hydroxy-p-toluylic acid
3-Hydroxy-p-toluylic acid
5-Hydroxy-o-toluylic acid
6-Hydroxy-m-toluylic acid
5-Hydroxy-1-naphthonic acid
Para-hydroxyphenylacetic acid
Para-hydroxybenzaldehyde
Ortho-hydroxybenzoic acid
Ortho-hydroxybenzyl alcohol
4,4-Dihydroxybiphenol
3,5-Dichloro-salicylic acid
5-Chloro-2-nitrophenol
2,5-Dihydroxyacetophenone
2,5-Dinitrophenol
2,4-Dinitrophenol
2,4-Dinitroresorcin
4,6-Dibromo-2-nitrophenol
2,5-Dimethyl hydroquinone Hydroxynaphthalene Derivatives 2,3-Dihydroxynaphthalene
β-Naphthol
α-Naphthol
1,6-Dihydroxynaphthalene
2,6-Dihydroxynaphthalene
2,7-Dihydroxynaphthalene
8-Amino-2-naphthol
2,2'-Dihydroxy-1,1'-binaphthyl
4,4'-Dihydroxy-1,1'-binaphthyl
3-Carboxy-2-naphthol Aniline Derivatives Meta-aminobenzoic acid
2-Amino-p-cresol
Ortho-aminophenol
Para-aminophenol
Para-chloroaniline
3,4-Diaminotoluene Active Methylene Group-Containing Compounds 1-Phenyl-3-methylpyrazolone (5)
1-Phenyl-3-carboxypyrazolone
Acetoacetic acid anilide
Acetoacetic-o-chloroanilide When used as the thermovolatile or sublimable azo coupler (*c*), it is preferred that the coupler be an acid addition salt. Acids useful for the formation of such salts may include the following:

Inorganic acids, such as
hydrochloric acid
hydrobromic acid, and
other hydrohalogenic acid;
Organic sulfonic acids, such as
p-toluene sulfonic acid, and
o-toluene sulfonic acid; and
Carboxylic acids, such as
chloroacetic acid ($ClCH_2$—COOH),
chloropropionic acid ($ClCH_2CH_2$·COOH),
acetic acid ($CH_3COOH$),
salicylic acid ($C_6H_4$ (OH)(COOH)),
2,6-dichlorobenzoic acid ($C_6H_3C_2$(COOH)),
3,4-dimethylbenzoic acid ($C_6H_3(CH_3)_2COOH$),
oxalic acid ($(COOH)_2$),
oxalic acid hydrate ($(COOH)_2 \cdot 2H_2O$),
o-sulfobenzoic acid ($C_6H_4(CO_2H)(SO_3h) + 3H_2O$),
trichloroacetic acid ($CCl_3COOH$),
formic acid (HCOOH),
benzoic acid ($C_6H_5COOH$),
methacrylic acid ($CH_2{=}C(CH_3)COOH$), and
butyric acid ($CH_3CH_2CH_2COOH$).

The preparation of acid additional salts of azo coupling components may be accomplished according to a conventional method by mixing an azo coupling component with an acid such as cited above in a suitable medium.

As coupler (*b*) to be used in combination with the above-mentioned coupler (*a*) in conducting the process, any coupler may be used as long as it has a lower coupling rate under the same developing conditions than coupler (*a*) actually used. In case a plurality of thermovolatile or thermosublimative couplers (*a*) are used, the coupling rate of coupler (*b*) should be lower than that of any of couplers (*a*). Selection of couplers (*a*) and (*b*) meeting the above requirement may be easily performed by those skilled in the art based on a simple experiment.

In addition to those having relatively low coupling rates among the above exemplified couplers (*a*), the following compounds may be used as coupler (*b*):

Phenol Derivatives 2,5,6-Trimethylphenol
2-Hydroxymethylphenol
β-(2-Hydroxyphenyl)-propionic acid
2-(ω-Phenylaminomethyl)-phenol
β-(4-Methyl-2-hydroxyphenyl)-glutaric acid
2,5-Dimethyl-6-(N-dimethylaminomethyl)-phenol
1,3-Dimethyl ether of pyrogallol
N-Lauryl-p-aminophenol
N-Acyl-m-aminophenol
Meta-hydroxy-acetoanilide
Ortho-N-hydroxyphenyl-monoguanidine
Para-N-hydroxyphenyl-biguanidine
2,5-Dimethyl-4-morpholinomethyl phenol
2-Methyl-5-isopropyl-morpholinomethyl phenol
4-Morpholinomethylresorcinol monomethyl ether
3,3',5-Trihydroxydiphenyl
3,3',5,5'-Tetrahydroxydiphenyl
2,2',4,4'-Tetrahydroxydiphenyl
2,4,4'-Trihydroxydiphenyl-2'-sulfonic acid
2,4,6,3',5'-Pentahydroxydiphenyl
2,2',4,4'-Tetrahydroxydiphenyl sulfide Naphthols 2,3-Dihydroxynaphthalene-o-sulfonic acid
2-Naphthol-3,6-Disulfonic acid
2,7-Dihydroxynaphthalene-3-sulfonic acid
2,8-Dihydroxynaphthalene-6-sulfonic acid
1,8-Dihydroxynaphthalene-8-sulfonic acid
1-8-Aminonaphthol-5-sulfonic acid
2,7-Dihydroxy-3,6-disulfonic acid
1,8-Benzoylaminonaphthol-2-sulfonic acid
1,8-Dihydroxynaphthalene-6-sulfonic acid
2-Hydroxy-3-naphthionic-N-β-hydroxyethyl amide
2-Hydroxy-3-naphthionic-N,N-bis-β-hydroxylether amide
8-Hydroxy-2-naphthionic-hydroxyethyl amide
1-(N-Carboethoxymethylamino)-8-naphthol-4-sulfonic acid
5-(Para-nitro)-benzamide-1-naphthol
1-Hydroxynaphthyl-7-phenyl-guanidine
2-Hydroxynaphthyl-8-biguanidine
1-Naphthol-3-(N-β-hydroxyethyl)-sulfonic amide
1-Naphthol-3-(N-o-methoxyphenyl)-sulfonic amide
Bis-[5-hydroxy-7-sulfo-naphthyl(2)]-amine
N,N-Bis[1-hydroxy-3-sulfo-naphthyl(6)]-thiourea Active Methylene Group-Containing Compounds Acetoacetic acid cyclohexylamide
Acetoacetic acid benzylamide
Cyanoacetoanilide
Cyanoacetomorpholine Heterocyclic Compounds 1-(3'-Sulfoamide)-phenyl-3-methylpyrazolone-5
1-(4'-Carboxy-ethylphenyl)-3-dodecyl-pyrazolone-5
8-Hydroxy-1,2-naphthylimidazole
2-Methyl-4-hydroxybenzimidazole
7-Methyl-4-hydroxybenzothiazole
1,7-Dimethyl-4-hydroxy-benzotriazole
3-Hydroxythiophene-5-carboxylic acid
1-3-4-Cyclopentatrione In conducting the process, an original sheet for multi-color reproduction is first formed by applying at least one transparent or semi-transparent layer containing a thermovolatile or sublimable coupler (*a*) onto the surface of one or more preselected areas of a transparent or semi-transparent original sheet.

At this time, the original sheet can have opaque image areas on at least one surface, namely on one or both surfaces thereof. The layer containing a thermovolatile or sublimable coupler (*a*) can be applied to only one surface of the original sheet. When the original sheet has opaque image areas only on one surface thereof, said layer containing the coupler (*a*) is located only on the same or opposite surface of the preselected image among image areas and, if the original sheet has image areas on both surfaces, the layer containing the coupler (*a*) can be located only on preselected areas which are either or both the image areas on one surface of the original sheet and areas contiguous with the image areas on the opposite surface of the original sheet. In the present specification, the surface to which the layer containing a thermovolatile or sublimable coupler (*a*) is hereinafter called "coupler-applied surface".

The thus prepared original sheet for multi-color reproduction is superposed on a diazotype photosensitive material containing at least one diazonium compound (*c*) in a manner such that the layer of coupler (*a*) will confront the photosensitive surface of the photosensitive material, and the light-exposure and heating are effected coincidentally with the above superposition or after such superposition. Thus, the thermovolatile or sublimable coupler (*a*) is heat-transferred to the surface of the predetermined portions of the photosensitive material, and light resolution of the diazonium salt (*c*) in the photosensitive material is caused to occur depending on the light transmission. When the so exposed photosensitive material is developed by a conventional method, at the predetermined portions to which the coupler (*a*) has been heat-transferred, the diazonium salt (*c*) at the nonexposed area is selectively reacted with the coupler (*a*) to form a dyestuff (*c*)–(*a*), and at the other portion the diazonium salt (*c*) at the non-exposed portions is reacted with coupler (*b*) to form a dyestuff (*c*)–(*b*). Thus, a multi-colored reproductive copy in which the predetermined portion is colored in a hue different from that of the other portion is obtained.

The above-mentioned original sheet for multi-color reproduction may be prepared, for example, by a method comprising applying a coating composition containing the above-mentioned thermovolatile or sublimable coupler (*a*) onto the coupler-applied surface of a portion predetermined to have a different hue, or a transparent or semi-transparent original sheet. Another method comprises coating or impregnating a transparent or semi-transparent substrate with the composition containing the above-mentioned thermovolatile or sublimable coupler (*a*) and combining the resulting sheet for heat-transfer of the coupler (*a*) with the coupler-applied surface of the specific portion of the original predetermined to have a different hue in a manner such that the layer containing the coupler (*a*) will confront the photosensitive material.

A coating composition for treating the coupler-applied surface of an original sheet to form a layer for heat-transfer of the coupler (*a*) can be easily prepared by dispersing a coupler (*a*) into a liquid, semi-solid or solid dispersion medium.

Such treating agent will now be described by referring to some embodiments.

1. Ink-like composition for treating the coupler-applied surface of an original:

| | |
|---|---|
| Coupler (a) | 5.0 – 25.0% |
| Coloring material | 0 – 3.0% |
| Binder | 0 – 5.0% |
| Dispersion assistant | 0 – 2.0% |
| Dispersion medium | balance |

As the dispersion medium, water and organic solvents such as alcohol, toluene, xylene, esters and methyl ethyl ketone may be used. It is possible to incorporate a coloring material so as to confirm the formation of a film of the treating agent, or to use a binder for the purpose of obtaining a good fixation of the coupler.

The composition of the above formula is applied to the coupler-applied surface of a portion predetermined to have a different hue by means of a brush, an installed felt pen, a ball pen, coating roller, a sprayer or a printing machine.

2. Waxy composition for treating the coupler-applied surface of an original:

| | |
|---|---|
| Coupler (a) | 5.0 – 25.0% |
| Wax | 85.0 – 15.0% |
| Oil | 10.0 – 40.0% |
| Coloring material | 0 – 20.0% |

The composition of the above formula is shaped to have a crayon stick-like form or a chalk-like form, and the surface of a portion of an original predetermined to have a different hue is painted therewith. It is also possible to form a pressure-sensitive transfer sheet by melting the above composition or dissolving it in a suitable solvent and coating the melt or solution on a substrate such as paper and plastic film. The thus formed pressure-sensitive transfer sheet is superimposed on the coupler-applied surface of an original sheet, and then pressing is effected thereon by means of a typewriter or other writing means to form a heat-transferable layer on the coupler-applied surface of an original sheet predetermined to have a different hue.

3. Pasty composition for treating the coupler-applied surface of an original:

| | |
|---|---|
| Coupler (a) | 2.0 – 50.0% |
| Coloring material | 0 – 20.0% |
| Binder | 0 – 15.0% |
| Organic solvent | 0 – 15.0% |
| Oily dispersion medium | balance |

The components are placed into a ball mill and are kneaded for 2 – 3 hours sufficiently to obtain a homogeneous mixture. The resulting pasty composition can be used directly as a treating material for applying the coupler (*a*) to a portion of the original sheet preselected to have a different hue by means of a brush or a pen. Alternately, it is charged into a ball pen or the like and applied to a portion of the original sheet preselected to have a different hue.

An oily substrate that can disperse the above components uniformly therein and does not cause degradation or modification of these components can be used as the oily dispersion medium. For instance, linseed oil, paulownia oil, soybean oil, oleic acid, linolic acid, linoleic acid, other higher fatty acids, mineral oil and mixtures thereof are used and linseed oil, paulownia oil and oleic acid are especially preferably used.

Coloring materials and binders such as mentioned with respect to the ink-like composition may also be used in the pasty composition. The organic solvent should be miscible with the oily dispersion medium used and may be selected from those used as the liquid dispersion medium, with respect to the ink-like composition, in the case of the pasty composition. Those skilled in the art can readily select suitable organic solvents depending on the nature of the oil dispersion medium used.

In order to promote the drying of the pasty composition after coating, it is possible to incorporate therein a small amount of a drying agent such as cobalt naphthenate. Such drying agent is usually incorporated in an amount of up to 8% by weight, preferably up to 5% by weight.

4. Coupler-transferring sheet for treating the coupler-applied surface of an original:

The ink-like composition for treating the coupler-applied surface of an original, which was described in (1), or a composition obtained by incorporating a binder or an extender into such ink-like composition is coated on a transparent or semi-transparent sheet such as paper, plastic film or non-woven fabric. The thus formed sheet for heat-transferring the coupler is cut into a desired size, if necessary, and then applied to the surface of a portion of an original determined to have a different hue. It is possible to form a pressure-sensitive adhesive layer on the back surface of the coupler-transferring layer for preventing it from exfoliating from the original.

In order to aid the heat-transfer operation of the thermovolatile or sublimable azo coupler (*a*), there may be added to the above treating agent a sublimable, organic solid transfer promoter having no coupling property in itself. It is preferred that said transfer promoter generally be added to the above treating agents in amounts of from 5.0 to 30.0% by weight.

As such transfer promoter, there may be used any organic compound that exhibits a high sublimating property at temperatures exceeding room temperature, especially at temperatures exceeding 60° C. and has a melting point above 60° C., preferably above 100° C.

The transfer promoter may be chosen from naphthalene, naphthalene derivatives, terpene compounds, halogenated benzenes and other organic solid sublimative compounds. Typical examples of such transfer promoter are as follows:

Naphthalene
d-Camphor
Menthol
Camphene
Benzoic acid
Maleic anhydride
Phthalic anhydride
Oxalic acid Anthranic acid
Ethylboric acid
p-Hydroxyphenyl acetic acid
Atropine
2-Aminoquinoline
0-Chlorobenzoic acid
αChloroacrylic acid
Diacetone-D-glucose
1,4-Cyclohexadione
2,6-Dichlorobenzoic acid
Di-α-naphthyl ketone
N,N-diphenyl acetamide
2,4-Dimethyl-3-furan-carboxylic acid
Dimethylphosphinic acid
Cinnamylideneacetic acid
Tartronic acid
Thiourethane 2,3,4,5-Tetramethylpyrrol Triiodobenzene
α-Naphthyl ketone
1,8-Naphthylene diamine
Nitrobenzonitrile
Hydrochelidonic acid
Pyridine carboxylic acid
Pyrene
Phenanthrene
Phenylpropiolic acid
3-Furancarboxylic acid
0-Benzylbenzoic acid
Bornane
Meconine
Mesitylenic acid
5-Methyl-2-furancarboxylic acid
Lapachol The original sheet for multi-color development prepared with the use of the above-mentioned agent for treating the coupler-applied surface of an original sheet to be reproduced may be generally used 5 to 100 times although the applicable frequency of the repeated use varies depending on the amount of the coupler (*a*) coated, the coating method, the heating method and the developing method. Of course, when the heat-transferability of coupler (*a*) in the layer for heat-transferring the coupler is lowered, it is sufficient to supply an additional layer for heat-transferring the coupler.

The above-mentioned original sheet for multi-color development is superimposed on the photosensitive material of this invention in a manner such that the coupler-transferring layer applied on the original sheet will confront the photosensitive surface of the photosensitive material, and then the light exposure and heating are effected.

The exposure of the assembly consisting of the original sheet and the photosensitive material and the transfer of the thermovolatile or thermosublimative coupler (*a*) to the photosensitive surface may be effected simultaneously. For instance, where a mercury lamp is used as light source for exposure, the heat transfer of the coupler (*a*) may be effected simultaneously with the exposure by the heat conveyed through a cylinder glass of the light source maintained at a relatively high temperature. Of course, the heat transfer of the coupler (*a*) may also be effected by the radiation heating of an image of the original. The heat transfer of the coupler (*a*) may be effectively performed by heating the layer for heat-transferring the coupler at a temperature above 50° C., preferably above 70° C. and up to 180° C., though a preferable heating temperature varies to some extent depending on the kind of the coupler (*a*) and the heating time. It is also possible to adopt a method comprising superimposing the above-mentioned original for multi-color development and the photosensitive material, passing the assembly through a heated roller or an infrared radiation zone to heat the layer for heat-transferring the coupler at the above-mentioned temperature to effect the heat transfer of the coupler, and then passing the same through an exposure zone to effect the exposure of the photosensitive material.

It is also possible to adopt a method in which the exposure and heat transfer are conducted in an order reverse to that of the above method, namely a method comprising superimposing the original for multi-color development and the photosensitive material, passing the assembly through an exposure zone to effect the exposure of the photosensitive material and then passing the same through a heating zone to effect the heat transfer of the coupler (*a*).

The photosensitive material, which has been exposed to light and on a predetermined portion of which the coupler (*a*) has been heat-transferred, is then developed in the presence of a coupler (*b*) by conventional means. It is possible to incorporate the coupler (*b*) in the photosensitive material in advance, or to incorporate the coupler (*b*) in a developer. The development may be conducted by either a dry method or a wet method.

In accordance with the dry method, the development may be performed sufficiently only by exposing the light-exposed photosensitive material to a mixture of ammonia and steam. The development of a one-component type photosensitive paper in use for the dry method may be carried out by coating a liquid developer having, for instance, the following formula on the photosensitive material by dipping, roller coating or spraying:

| | |
|---|---|
| Coupler (b) | 0.2 - 5% |
| Alkali | 0.5 - 10% |
| Reducing agent | 0 - 20% |
| Surface active agent | 0 - 0.5% |
| Water | balance |

In the case of a two-component type photosensitive paper in use for the wet method, the development is achieved by contacting the photosensitive paper with an aqueous liquid developer containing an alkali.

In accordance with the above developing operation, in the unexposed latent image area of the portion to which the coupler (*a*) has been heat-transferred, a dye (*c*)–(*a*) having a certain hue or color is formed by the selective reaction of the heat-transferred coupler (*a*) with the diazonium salt (*c*) and at the same time, in the unexposed latent image areas to which the coupler (*a*) has not been heat-transferred, a dye (*c*)–(*b*) having a different hue or color from said dye (*c*)–(*a*) is formed by the reaction of the coupler (*b*) with the diazonium salt (*c*), thus producing a multi-colored copied image.

Thus, multi-colored reproductive copies in which the predetermined portion is colored by a dyestuff formed of coupler (*a*) and diazonium salt (*c*) and the other portion is colored by a dyestuff formed by coupler (*b*) and diazonium salt (*c*) can be provided.

The present process may be performed by using the apparatus recited in U.S. Pat. No. 3,715,213, Nihyakumen et al, in accordance with the following quoted portion thereof:

"In accordance with this invention it is possible to obtain copies in which predetermined portions are clearly colored in different hues, and further, the multicolor development can be effected only by one developing step. Still further, in case the original is once treated, at least 5 sheets, generally 20 to 100 sheets, of multicolored reproductive copies can be obtained from the original. Accordingly, it is unnecessary to repeat the treatment of the original for every one copy. Still in addition, in this invention the treated original for multicolor development can be easily restored into the former untreated condition by peeling off the sheet of the heat-transferable coupler or by subjecting the coupler-coated original to a meter heat treatment at about 100° C. The reproduction process of this invention is particularly advantageous for reproducing important or significant portions of originals such as papers, drawings and charts into hues different from those of other portions and is effective for obtaining ordinary multicolor copies or colored copies."

This invention will be further described by referring to the following examples:

Example A

Preparation of Ink-like Composition for Forming Red Color:

| | |
|---|---|
| A solution of the following formula: | |
| 1-Phenyl-3-methyl-pyrazolone (5) | 25 g |
| Alkyd resin | 5 g |
| Thiourea | 5 g |
| Ethyleneglycol | 10 g |
| Ethanol | balance |
| Total | 100 ml |

is prepared by dissolving the above ingredients successively into a part of ethanol under agitation, and after they have completely been dissolved, the remainder of ethanol is added to the solution to make the total volume of the solution 100ml. The thus obtained composition is charged into a vessel, and it is used as a treating agent to be applied to a portion of an original preselected to be colored in red. The application of the composition may be by means of a brush, pen or coating roller. Alternately, the composition can be impregnated into an installed felt pen and applied to the original.

Examples B to F

Coupler-containing agents for treating original or installed felt pens are prepared by repeating the procedures of Example A using the following ink-like compositions instead of the red-color-forming ink-like composition.

Example B

A yellow-color-forming ink-like composition of the following formula:

| | |
|---|---|
| Acetoacetic acid anilide | 25 g |
| Polyvinyl acetal resin | 5 g |
| Glycerine | 10 g |
| Sodium thiosulfate | 3 g |
| Methanol | balance |
| Total | 100 ml |

Example C

A blue-color-forming ink-like composition of the following formula:

| | |
|---|---|
| 2,3-Dihydroxynaphthalene | 25 g |
| Cellulose diacetate resin (20% acetone solution) | 15 g |
| Thiourea | 3 g |
| Ethanol | balance |
| Total | 100 ml |

Example D

A yellowish brown-color-forming ink-like composition of the following formula:

| | |
|---|---|
| Resorcin | 25 g |
| Vinyl acetate resin emulsion | 10 ml |
| Thiourea | 5 g |
| Citric acid | 3 g |
| Water | 30 ml |
| Ethanol | balance |
| Total | 100 ml |

Example E

A brown-color-forming ink-like composition of the following formula:

| | |
|---|---|
| Pyrogallol | 20 g |
| Ethyl cellulose | 5 g |
| Tartaric acid | 5 g |
| Stannous chloride | 5 g |
| Ethanol | balance |
| Total | 1 liter |

Example F

A violet-color-forming ink-like composition of the following formula:

| | |
|---|---|
| 2,3-Dihydroxynaphthalene | 20 g |
| 1-Phenyl-3-methylpyrazolone-(5) | 5 g |
| Butylated urea resin | 5 g |
| Diethylene glycol | 10 g |
| Methanol | balance |
| Total | 100 ml |

Example G

Preparation of Red-Color-Forming Pasty Composition:

| | |
|---|---|
| The following ingredients | |
| 1-Phenyl-3-methylpyrazolone-(5) | 40 g |
| Linseed oil-modified alkyd resin | 8 g |
| Linolic acid | 10 g |
| Cobalt naphthenate | 5 g |
| Linseed oil | balance |
| Total | 100 ml |

are pre-mixed under agitation, and then are uniformly blended and dissolved by treating them in a ball mill for 2 – 3 hours to obtain a red-color-forming pasty composition. The composition is directly used as a red-color-forming agent to be applied to a portion of an original preselected to be colored in red by means of a brush or a pen, or after it has been charged into a ball pen or the like.

Examples H to K

Pasty agents to be used for treating a portion of an original preselected to be colored in different hues and ball pens charged with such agents are prepared in the same manner as in Example G by employing the following compositions instead of the composition of Example G.

Example H

A yellow-color-forming pasty composition of the following formula:

| | |
|---|---|
| acetoacetic acid anilide | 30 g |
| Oleic acid | 10 g |
| Stearic acid | 20 g |
| Paulownia oil | balance |
| Total | 100 ml |

Example I

A blue-color-forming pasty composition of the following formula:

| | |
|---|---|
| 2,3-Dihydroxynaphthalene | 30 g |
| Polyvinyl acetal resin | 10 g |
| Thiourea | 5 g |
| Ethanol | 10 ml |
| Oleic acid | 10 g |
| Oil Blue (C.I. 74350) | 1 g |
| Mineral oil | balance |
| Total | 100 ml |

Example J

A yellowish brown-color-forming pasty composition of the following formula:

| | |
|---|---|
| Resorcin | 35 g |
| Ethyl cellulose | 7 g |
| Thiourea | 5 g |
| Methanol | 7 ml |
| Oleic acid | 5 g |
| Palmitic acid | 5 g |
| Linseed oil | balance |
| Total | 100 ml |

Example K

A violet-color-forming pasty composition of the following formula:

| | |
|---|---|
| 1-Phenyl-3-methylpyrazolone-(5) | 35 g |
| 2,3-Dihydroxynaphthalene | 9 g |
| Soybean oil-modified alkyd resin | 10 g |
| Oleic acid | 15 g |
| Stannous chloride | 5 g |
| Soybean oil | balance |
| Total | 1 liter |

Example L

Preparation of a Red-Color-Forming Solid Composition:

A red-color-forming agent for treating a portion of an original preselected to be colored in red is prepared from a red-color-forming composition of the following formula:

| | |
|---|---|
| 1-Phenyl-3-methyl-pyrazolone-(5) | 50 g |
| Palmitic acid | 30 g |
| Talc ("Hifiller" manufactured by Matsumura Sangyo Kabushiki Kaisha) | 15 g |
| $SiO_2$ ("Aerogil" manufactured by Nippon Aerogil Kabushiki Kaisha) | 5 g |

in the following manner. The palmitic acid is charged into a mixer, and heated and melted at 90° C. The coupler, talc and $SiO_2$ are added to the melt and the mixture is agitated for 20 – 30 minutes. The thus formed semi-molten mixture is sufficiently kneaded by means of three rolls. The kneaded composition is placed into a molder and is molded in a crayon, chalk or lip-stick form. It is used as an agent for treating a portion of an original preselected to be colored in a different hue. Alternately, the above kneaded composition is pre-molded into a column of a diameter of about 25 mm and a length of about 15 cm and then molded into a pencil lead by means of an extension molder. Then, a wooden or paper reinforcing material is bonded or wrapped around the thus molded lead to obtain a pencil-like agent for treating a portion of an original preselected to be colored in a different hue.

Examples M to P

Crayon, chalk, lip-stick or pencil-like solid compositions to be used as agents for treating a portion of an original preselected to be colored in a different hue are prepared in the same manner as in Example L by employing the following solid compositions instead of the composition of Example L.

Example M

A yellow-color-forming solid composition of the following formula:

| | |
|---|---|
| Acetoacetic acid anilide | 50 g |
| Stearic acid | 30 g |
| Paraffin | 10 g |
| Terra alba | 5 g |
| $SiO_2$ (Carplex No. 80 manufactured by Shionogi Seiyaku Kabushiki Kaisha) | 5 g |

Example N

A blue-color-forming solid composition of the following formula:

| | |
|---|---|
| 2,3-Dihydroxynaphthalene | 50 g |
| Lauric acid | 30 g |
| Talc ("Hilfiller" manufactured by Matsumura Sangyo Kabushiki Kaisha) | 10 g |
| Bees wax | 10 g |

Example O

A brown-color-forming solid composition of the following formula:

| | |
|---|---|
| Pyrogallol | 50 g |
| Lauric acid | 35 g |
| Diatomaceous earth | 10 g |
| Thiourea | 5 g |

Example P

A violet-color-forming solid composition of the following formula:

| | |
|---|---|
| 2,3-Hydroxynaphthalene | 40 g |
| 1-Phenyl-3-methylpyrazolone-(5) | 10 g |
| Palmitic acid | 25 g |
| Paraffin | 10 g |
| ZnO | 10 g |
| Thiourea | 5 g |

Example Q

Preparation of Pressure-Sensitive Sheet:

A red-color-forming composition for a pressure-sensitive sheet having the following formula:

| | |
|---|---|
| 1-Phenyl-3-methylpyrazolone-(5) | 25 g |
| Talc ("Hilfiller" manufactured by Matsumura Sangyo Kabushiki Kaisha) | 7 g |
| $SiO_2$ (Aerogil 200 manufactured by Nippon Aerogil Kabushiki Kaisha) | 3 g |
| Mineral oil | 25 g |
| Palmitic acid | 15 g |
| Oleic acid | 15 g |
| Permanent Red | 10 g |

in the following manner. The above ingredients are successively charged into a mixer, and they are preheaded at 90° C. for 20 – 30 minutes. The resulting mixture is placed in a ball mill and pregranulated at 80° – 90° C. for 2 – 3 hours. Then, the composition in the state heated at 80° – 90° C. is coated on a base paper for a pressure-sensitive copying sheet in an amount of about 25 g/m² by a rod bar coating method, and dried to obtain a pressure-sensitive sheet. This pressure-sensitive sheet is superimposed on an original sheet in the same manner as adopted for ordinary pressure-sensitive paper, at a portion of the original sheet preselected to be colored in red.

Examples R to U

Pressure-sensitive sheets as agents for treating a portion of an original preselected to be colored in a different hue are prepared in the same manner as in Example Q by employing the following compositions instead of the composition of Example Q.

Example R

A yellow-color-forming composition for a pressure-sensitive sheet having the following formula:

| | |
|---|---|
| Acetoacetic acid anilide | 25 g |
| Stearic acid | 15 g |
| Paraffin | 5 g |
| Linseed oil | 15 g |
| Mineral oil | 30 g |
| Diatomaceous earth | 10 g |

Example S

A blue-color-forming composition for a pressure-sensitive sheet having the following formula:

| | |
|---|---|
| 2,3-Hydroxynaphthalene | 25 g |
| Lauric acid | 15 g |
| Talc ("Hifiller" manufactured by Matsumura Sangyo Kabushiki Kaisha) | 5 g |
| Cotton wax | 30 g |
| Paulownia oil | 30 g |
| Oleic acid | 15 g |
| Oil Blue (C.I. 74350) | 5 g |

Example T

A brown-color-forming composition for a pressure-sensitive sheet having the following formula:

| | |
|---|---|
| Pyrogallol | 25 g |
| Lauric acid | 15 g |
| Diatomaceous earth | 10 g |
| Paraffin | 5 g |
| Soybean oil | 30 g |
| Mineral oil | 10 g |
| Thiourea | 5 g |

Example U

A black-color-forming composition for a pressure-sensitive sheet having the following formula:

| | |
|---|---|
| 2,3-Dihydroxynaphthalene | 18 g |
| 1-Phenyl-3-methylpyrazolone-(5) | 4 g |
| Resorcin | 3 g |
| Stearic acid | 20 g |
| Titanium oxide | 10 g |
| Linseed oil | 10 g |
| Mineral oil | 25 g |
| Cobalt naphthenate | 5 g |
| Carbon black | 5 g |

The process of this invention for obtaining a diazotype multi-colored copy with the use of the treating agents prepared by above Examples A-U will now be illustrated by the following examples:

Example 1

Multi-color-forming, One-component Diazotype Photosensitive Paper For Use In Wet Development A pre-treating agent for a base paper was prepared by dispersing homogeneously, by means of a high speed rotating stirrer, the following components:

| | |
|---|---|
| Styrene-Butadiene-latex, (DL-620, manufactured by Ashahi-Dow Co., Ltd.) | 350 ml |
| Water | balance |
| Total | 1 liter |

The solution was coated on a base paper for a diazotype photosensitive copying sheet by an air knife coater in an amount of 5 g/m² and dried to form a pre-treated base paper for a diazotype photosensitive copying sheet. Separately, a sensitizing composition was prepared by dissolving successively 10 g of 4-diazo-2,5-diethoxybenzoylaniline chloride·½$ZnCl_2$ double salt, 5 g of citric acid, 8 g of collidal silica "Aerosil" ($SiO_2$), 80 g of dextrin and 0.1 g of Patent Blue into water to form 1 liter of a solution. The solution was coated on the pre-treated base paper by means of an air knife coater dried to form a diazotype photosensitive copying sheet for wet development.

A semi-transparent first original having an image and a photosensitive sheet for a diazotype intermediate copying original prepared by a customary method were superimposed, and the assembly was exposed to light emitted from above to form an intermediate copying original. A part of the image of this intermediate copying original was treated with the ink composition prepared in Example A and another part of the image was treated with the treating material prepared in Example B to obtain an original for multi-color reproduction.

The thus formed original for multi-color reproduction was superimposed on the above photosensitive sheet so that the treated surface of the original had a close face-to-face contact with the photosensitive layer of the photosensitive material, and the assembly was heated by a mercury lamp to form a latent image of the diazonium salt and simultaneously heat-transfer the heat-transferable couplers to the areas of the photosensitive sheet corresponding to the treated parts of the original. Then, the so exposed and heat-transferred photosensitive sheet was developed with use of a liquid developer of the following formula:

| | |
|---|---|
| 1-Hydroxynaphthalene-4-sulfonic acid | 20 g |
| Potassium carbonate | 20 g |
| Sodium thiosulfate | 40 g |
| Sodium bicarbonate | 30 g |
| Activating agent | 1 g |
| Water | balance |
| Total | 1 liter |

Thus, a clear multi-color reproductive copy in which a portion corresponding to the portion treated with the treating material prepared in Example A was colored in red, a portion corresponding to the portion treated with the treating material of Example B was colored in yellow and another portion corresponding to the non-treated portion was colored in bluish violet was obtained.

Example 2

Multi-color-forming, Two-component Diazotype Photosensitive Paper For Use In Dry Development A base paper for a diazotype photosensitive copying sheet was treated in the same manner as in Example 1 with the same pre-treating agent as used in Example 1, and a sensitizing composition of the following formula:

| | |
|---|---|
| 4-Diazo-N,N-diethyl aniline fluoroborate | 20 g |
| Tartaric acid | 30 g |
| Methanol | 200 ml |
| 2,3-Dihydroxynaphthalene-6-sulfonic acid | 20 g |
| $SiO_2$ ("Snowtex O" manufactured by Nissan Kagaku) | 400 ml |
| Saponin | 5 g |
| Patent Blue | 0.1 g |
| Water | balance |
| Total | 1 liter |

was coated on the pre-treated base paper by means of an air knife coater to form a photosensitive sheet.

The sheet was superimposed on an original in which the back surface of a portion was treated with the solid treating agent prepared in Example L and the back surface of another portion was treated with the treating agent prepared in Example O. Then, the assembly was heated and exposed to light by means of a mercury lamp to form a latent image of the diazonium salt.

Next, the so treated sheet was subjected to development with gasified ammonia and steam. Thus, a clear multi-color copy of a high color contrast was obtained, in which a portion corresponding to the portion treated with the agent of Example L was colored in red, a portion corresponding to the portion treated with the agent of Example O was colored in brown and another portion corresponding to the untreated portion was colored in blue.

Example 3

Multi-color-forming, Two-component Diazotype Photosensitive Paper For Use In Dry Development A pre-treating agent was prepared by stirring and dispersing the following components by means of a high speed stirrer:

| | |
|---|---|
| Polyvinyl acetate resin emulsion, ("Mowinyl DC" manufactured by Hoechst AG) | 300 g |
| Water | balance |
| Total | 1 liter |

The resulting dispersion was coated on a base paper for a diazotype photosensitive copying sheet by means of an air knife coater and dried to form a diazotype photosensitive copying sheet. A sensitizing solution of the following formula:

| | |
|---|---|
| 4-Diazo-N,N-dimethylaniline fluoroborate | 15 g |
| Tartaric acid | 70 g |
| 2,7-Dihydroxynaphthalene-3,6-disulfonic acid | 20 g |
| 2,2',4,4'-Tetrahydroxydiphenyl sulfide | 15 g |
| Colloidal silica ("Snowtex C" manufactured by Nissan Kagaku) | 400 ml |
| Saponin | 5 g |
| Patent Blue | 0.1 g |
| Water | balance |
| Total | 1 liter |

was coated on the pre-treated base paper by means of an air knife coater and dried to form a photosensitive copying sheet, whose sensitivity was hardly changed after aging.

An intermediate copying original having opaque reverse images was prepared according to the customary diazotype reproduction method. The surface of a preselected reverse image of the intermediate copying sheet was treated with the pasty treating agent prepared in Example H, the surface of another preselected reverse image was treated with the treating agent prepared in Example G, and the surface of still another preselected reverse image was treated with the treating agent prepared in Example I. The so treated intermediate copying original was superimposed on the above photosensitive sheet so that the treated surface of the original had a face-to-face contact with the photosensitive layer of the photosensitive sheet. Then, the assembly was heated and exposed to light by means of a mercury lamp to form a latent image of the diazonium salt and effect the heat transfer of the coupler.

Next, the so treated sheet was subjected to development with gasified ammonia and steam. Thus, a clear multi-color copy in which a portion corresponding to the portion treated with the agent of Example H was colored in yellow, a portion corresponding to the portion treated with the agent of Example G was colored in red, a portion corresponding to the portion treated with the agent of Example I was colored in bluish violet, and another portion corresponding to the untreated portion was colored in dark black was obtained.

Example 4

Multi-color-forming, Two-component Diazotype Photosensitive Paper For Use In Dry Development A pre-treating agent for a base paper was prepared by stirring and dispersing the following components by means of a high speed stirrer:

| | |
|---|---|
| Polyvinyl chloride emulsion, (Manflex 4518 manufactured by Mitubishi-Monsanto Co., Ltd.) | 350 ml |
| Water | balance |
| Total | 1 liter |

The resulting dispersion was coated on a base paper for a diazotype photosensitive copying sheet by means of an air knife coater to form a pre-treated base paper and dried to form a pre-treated base paper for a diazotype photosensitive copying sheet. A sensitizing solution of the following formula:

| | |
|---|---|
| 4-Diazo-N-hydroxyethyl-N-methylaniline chloride | 15 g |
| Citric acid | 30 g |
| Silica powder, (Carplex No. 80 manufactured by Shionogi Seiyaku) | 80 g |
| Bis-[5-hydroxy-7-sulfonaphyl(2)]amine | 15 g |
| Saponin | 5 g |
| Ethanol | 100 ml |
| Patent Blue | 0.1 g |
| Water | balance |
| Total | 1 liter |

was coated on the pre-treated base paper by means of a customary coating method such as using an air knife coater, and dried to form a photosensitive copying sheet.

Separately, a semi-transparent original having an opaque image was superimposed on a conventional diazotype photosensitive sheet (for yellowish brown coloration) for an intermediate copying sheet so that the image surface of the original had a face-to-face contact with the photosensitive layer of the photosensitive material, and the assembly was exposed to ultraviolet rays emitted from the side of the original and developed with ammonia-steam to form an intermediate copying original. Then, in the thus formed original, a second image was written on the surface opposite to the image-carrying surface to thereby obtain an original having an image on both surfaces. The surface of a part of one image on one surface of the original was treated with the solid agent prepared in Example L and the back surface of the second image on the opposite surface of the original was treated with the treating agent of Example M to obtain an original for multi-color reproduction.

The thus formed original was superimposed on the above photosensitive paper so that the treated surface of the original had a face-to-face contact with the photosensitive layer of the photosensitive paper. Then, the assembly was exposed to light and heat emitted from the side of the original to thereby form a latent image of the diazonium salt and simultaneously accomplish the heat transfer of the heat-transferable couplers. The thus treated photosensitive paper was developed with ammonia-steam. Thus, a three-color copy was obtained, in which the portion corresponding to the part treated with the treating agent of Example L was colored in red, the portion corresponding to the part treated with the treating agent of Example M was colored in yellow and the portion corresponding to the untreated part was colored in blue.

Example 5

Multi-color-forming, Two-component Diazotype Photosensitive Paper For Use In Dry Development A pre-treating agent for a base paper was prepared by stirring and dispersing the following components by means of a high speed stirrer:

| | |
|---|---|
| Vinylidene chloride emulsion | 300 g |
| Water | balance |
| Total | 1 liter |

A base paper suitable for formation of a second original for diazotype reproduction, such as tracing paper, was coated and impregnated with the above dispersion by means of a roller coater, followed by drying to form a pre-treated base paper. A sensitizing composition of the following formula:

| | |
|---|---|
| 4-Diazo-N,N-diethylaniline fluoroborate | 25 g |
| Colloidal silica ("Snowtex C" manufactured by Nissan Kagaku) | 400 m |
| Sodium-2,7-dihydroxynaphthalene-3,6-disulfonate | 15 g |
| Ethanol | 100 ml |
| Tartaric acid | 50 g |
| Saponin | 5 g |
| Patent Blue | 0.1 g |
| Water | balance |
| Total | 1 liter |

was coated on the pre-treated base paper by a customary coating method such as an air knife coater and dried to form a photosensitive copying sheet.

The sheet was superimposed on an original in which the back surface of a portion was treated with the pressure-sensitive sheet prepared in Example Q and the back surface of another portion was treated with the pressure-sensitive sheet prepared in Example R. Then, the assembly was heated and exposed to light by means of a mercury lamp to form a latent image of the diazonium salt.

Next, the thus treated sheet was subjected to development with gasified ammonia and steam. A clear multi-color copy of a high color contrast was obtained, in which a portion corresponding to the portion treated with the agent of Example Q was colored in red, a portion corresponding to the portion treated with the agent of Example R was colored in yellow and another portion corresponding to the untreated portion was colored in blue.

Example 6

Multi-color-forming, Two-component Diazotype Photosensitive Paper For Use In Dry Development A pre-treating agent was prepared by dispersing the following components for three minutes by means of a ultrasonic disperser:

| | |
|---|---|
| Polyvinyl acetate/acrylic acid copolymer (Polyzol PS-120 manufactured by Shyowa Kobunshi Co., Ltd.) | 350 ml |
| Water | balance |
| Total | 1 liter |

Immediately, the dispersion was coated on a base paper for a photosensitive copying sheet in an amount of 5–6 g/m² by means of a customary method such as an air knife coater and dried to form a pre-treated base paper. A sensitizing composition of the following formula:

| | |
|---|---|
| 4-Diazo-2,5-diethoxy-N-phenyl morpholine . $\frac{1}{2}ZnCl_2$ | 15 g |
| Tartaric acid | 50 g |
| Methanol/silica ("Methanolsol" manufactured by Nissan Kagaku) | 400 ml |
| 2,3-Dihydroxynaphthalene-6-sulfonic acid | 15 g |
| Vinyl acetate resin emulsion ("Mowinyl DC" manufactured by Hoechst AG) | 10 ml |
| Saponin | 5 g |
| Patent Blue | 0.1 g |
| Water | balance |
| Total | 1 liter |

was coated on the pre-treated base paper by an air knife coater and dried to form a photosensitive sheet.

The sheet was superimposed on an original in which the back surface of a portion was treated with the solid treating agent prepared in Example L and the back surface of another portion was treated with the treating agent prepared in Example M. Then, the assembly was heated and exposed to light by means of a mercury lamp to form a latent image of the diazonium salt.

Next, the thus treated sheet was subjected to development with gasified ammonia and steam. A clear multi-color copy of a high color contrast was obtained, in which a portion corresponding to the portion treated with the agent of Example L was colored in red, a portion corresponding to the portion treated with the agent of Example M was colored in yellow and another portion corresponding to the untreated portion was colored in blue.

Example 7

Multi-color-forming, Two-component Diazotype Photosensitive Paper For Use In Dry Development A pre-treating agent was prepared by stirring and dissolving the following components by means of a high speed stirrer:

| | |
|---|---|
| Stylene/Maleic acid-copolymer emulsion (Styrene CM-3 manufactured by Sankyo Kasei) | 200 g |
| Aqueous ammonia | 30 ml |
| Water | balance |
| Total | 1 liter |

The solution was coated on a base paper by means of a wire bar coater and dried to form a pre-treated base paper. The same sensitizing composition as used in Example 6 was coated on the pre-treated base paper and dried to form a photosensitive copying sheet. When this copying sheet was heated, exposed and developed in the same manner as in Example 6, there was was obtained a result similar to that of Example 6.

Example 8

Multi-color-forming, Two-component Diazotype Photosensitive Paper For Use In Dry Development A pre-treating agent was prepared by stirring and dissolving the following components by means of a high speed stirrer:

| | |
|---|---|
| Polyvinyl chloride emulsion (Monflex 4514 manufactured by Mitsubishi-Monsanto Co., Ltd.) | 300 ml |
| Water | balance |
| Total | 1 liter |

The resulting solution was coated on a base paper by means of a wire doctor bar coater and dried to form a pre-treated base paper. The same sensitizing solution as used in Example 2 was coated on the pre-treated base paper and dried to form a photosensitive sheet. This photosensitive sheet was heated, exposed and developed in the same manner as in Example 2. A similar result to that in Example 2 was obtained.

Example 9

Multi-color-forming, Two-component Diazotype Photosensitive Paper For Use In Dry Development A pre-treatingg agent was prepared by stirring and dissolving the following components by means of a high speed stirrer:

| | |
|---|---|
| Ester of acrylic acid resin emulsion (Mowinyl 710 manufactured by Hoechst AG) | 350 ml |
| Water | balance |
| Total | 1 liter |

The resulting solution was coated on a base paper for a diazotype photosensitive copying sheet by a customary coating method such as using a wire bar coater or a dip coating method, and then dried to form a pre-treated base paper. The same sensitizing composition as used in Example 5 was coated on this pre-treated base paper to form a photosensitive copying sheet. When the copying sheet was exposed and developed in the same manner as in Example 5, a result similar to that in Example 5 was obtained.

Example 10

Multi-color-forming, Two-component Diazotype Photosensitive Paper For Use In Wet Development A pre-treating solution was prepared by dispersing homogeneously the following components for three minutes by means of an ultrasonic disperser:

| | |
|---|---|
| Polyethylene/vinyl chloride resin (Polyzol EVA,AD-1 manufactured by Shyowa Kobunshi Co., Ltd.) | 350 ml |
| Water | balance |
| Total | 1 liter |

The resulting dispersion was coated on a base paper for a diazotype photosensitive copying sheet in an amount of 4–5 g/m² by means of a wire bar coater and dried to form a pre-treated base paper for a diazotype photosensitive copying sheet. A sensitizing composition of the following formula:

| | |
|---|---|
| 4-Diazo-2,5-dibutoxy-N-phenyl morpholine fluoroborate | 20 g |
| Tartaric acid | 40 g |
| β-Hydroxynaphthoic acid aminoethylamine hydrochloride | 10 g |
| Methanol-$SiO_2$ ("Methanolsol" manufactured by Nissan Kagaku) | 400 ml |
| Patent Blue | 0.1 g |
| Water | balance |
| Total | 1 liter |

was applied on the pre-treated base paper by means of an air knife coater to form a photosensitive copying sheet. The photosensitive paper was superimposed on an original, a part of the back surface of which was treated with the treating agent of Example A and another part of the back surface of which was treated with the agent of Example B. Then, the assembly was heat treated in a manner such that the treated surface of the original confronted the photosensitive layer of the photosensitive paper, and exposed and printed by means of a fluorescent lamp to form a latent image of the diazonium salt, followed by development with gasified ammonia and steam or an alkaline liquid developer of the following formula:

| | |
|---|---|
| Potassium carbonate | 20 g |
| Sodium thiosulfate | 40 g |
| Sodium bicarbonate | 30 g |
| Potassium tetraborate | 5 g |
| Water | balance |
| Total | 1 liter |

Thus, a clear three-color reproductive copy was obtained, in which a portion corresponding to the part of the original treated with the agent of Example A was colored in red, a portion corresponding to the part of the original treated with the agent of Example B was colored in yellow and a portion corresponding to the untreated part was colored in blue.

Comparative Example

This example demonstrates that, in working the process for diazotype multi-color reproduction, there takes place a definite difference in heat-transfer capacity (acceptance capacity) of the thermovolatile of sublimable coupler onto the photosensitive layer of a photosensitive material depending on the kind of resin forming a continuous precoating layer of said photosensitive material used in the above process.

In this example, the following resins were employed in the formation of continuous precoating layers of the photosensitive material.

Styrene-butadiene copolymerizable resin (S-B)
Vinyl chloride resin (PVC)
Acrylic acid ester resin (PAE)
Vinyl acetate resin (PVAc)
Vinylidene chloride resin (PVDC)
Polyvinyl alcohol (PVA)
Butylated urea resin (PUB)
Polypropylene resin (PP)
Polyvinyl acetal resin (PVAT)
Carboxymethyl cellulose resin (CMC)

1. Preparation of Photosensitive Material

A water dispersion of the resin or a solvent solution [20% resin solid content] as the above treating agent was coated on a slick paper by means of an air knife coater to be about 2 g/cm$^2$ thick and dried to form a continuous precoating layer of the resin on the surface of the paper. In succession, a photosensitive composition for multi-color development of the following formula was coated on the surface of said precoating layer by means of an air knife coater and dried to form a photosensitive sheet for multi-color development.

| | |
|---|---|
| 4-Diazo-N,N'-dimethylaniline chloride . ½2 | 20 g |
| Tartaric acid | 100 g |
| Colloidal silica ("Snowtex O" manufactured by Nissan Kagaku) | 450 ml |
| Thiourea | 30 g |
| Saponin | 5 g |
| Patent Blue | 0.1 g |
| Polyvinyl acetate resin emulsion ("Movinyl DC" manufactured by Hoechst Synthetic K.K.) | 50 ml |
| Add water until the total volume is 1l. | |

2. Heat-transfer Test of the Thermovolatile or Sublimable Coupler to the Surface of a Photosensitive Layer of the Photosensitive Material The sensitive sheet for photosensitive multi-color development was superimposed on a transparent original sheet having an opaque image, whose preselected portion corresponding to the image was coated with the ink-like coupler of Example A, another portion thereof corresponding to the image was coated with the ink coupler of Example B, and a third portion thereof corresponding to the image was coated with the coupler of Example C so that the photosensitive layer of said photosensitive sheet came into face-to-face contact with said original sheet coated with the coupler. This laminate was sandwiched between heated plates and subjected to heat treatment at a pressure of 5 kg/m$^2$ and at temperatures shown in the following table, for 10 seconds. By way of the treatment, thermovolatile or sublimable couplers coated to the back surface of the original sheet were heat-transferred to the portion corresponding to the photosensitive surface of the photosensitive sheet.

Thereafter, when the photosensitive sheet with the coupler heat-transferred thereto was developed with gasified ammonia, the heat-transferred coupler became coupled with diazonium salt to prepare a multi-color reproductive copy, in which a portion corresponding to the part of the photosensitive copy treated with the coupler of Example A was colored in red, a portion corresponding to the part treated with the coupler of Example B was colored in yellow and a portion corresponding to the part treated with the coupler of Example C was colored in blue.

The acceptance capacity (heat-transfer capacity) of the thermovolatile or sublimable coupler of each photosensitive sheet was determined by measuring the image concentration of each photosensitive sheet so obtained.

The image concentration [-log Y value] of each reproductive copy was determined by following the procedure of JIS Z-8722 using a color difference meter CS-4A manufactured by Nippon Denshoku K.K. The results obtained are tabulated as stated below.

Table

| | Color-forming treating agent | Example A (Red) | | | Example B (Yellow) | | | Example C (Blue) | | |
|---|---|---|---|---|---|---|---|---|---|---|
| Resin forming a precoating layer | Temp. (°C.) | 80 | 100 | 150 | 80 | 100 | 150 | 80 | 100 | 150 |
| | S-B | 0.08 | 0.15 | 0.41 | 0.08 | 0.14 | 0.30 | 0.15 | 0.24 | 0.79 |
| | PVC | 0.13 | 0.18 | 0.36 | 0.05 | 0.15 | 0.22 | 0.10 | 0.29 | 0.53 |
| This | PAE | 0.07 | 0.08 | 0.32 | 0.01 | 0.02 | 0.20 | 0.06 | 0.08 | 0.54 |
| Invention | PVAc | 0.08 | 0.15 | 0.35 | 0.02 | 0.13 | 0.20 | 0.09 | 0.28 | 0.50 |
| | PVDC | 0.07 | 0.17 | 0.37 | 0.03 | 0.13 | 0.23 | 0.10 | 0.28 | 0.55 |
| | PVA | 0.02 | 0.14 | 0.21 | 0.02 | 0.05 | 0.06 | 0.06 | 0.09 | 0.27 |
| Comparison | PUB | 0.01 | 0.03 | 0.08 | 0.01 | 0.02 | 0.04 | 0.01 | 0.03 | 0.05 |
| | PP | 0.01 | 0.05 | 0.09 | 0.01 | 0.04 | 0.09 | 0.02 | 0.08 | 0.29 |
| | PVAT | 0.02 | 0.13 | 0.20 | 0.02 | 0.04 | 0.06 | 0.05 | 0.07 | 0.25 |
| | CMC | 0.01 | 0.02 | 0.05 | 0.01 | 0.02 | 0.05 | 0.01 | 0.04 | 0.09 |

Table-continued

| Resin forming a precoating layer / Color-forming treating agent Temp. (°C.) | Example A (Red) | | | Example B (Yellow) | | | Example C (Blue) | | |
|---|---|---|---|---|---|---|---|---|---|
| | 80 | 100 | 150 | 80 | 100 | 150 | 80 | 100 | 150 |
| Product using no resin | 0.03 | 0.08 | 0.17 | 0.01 | 0.03 | 0.04 | 0.06 | 0.10 | 0.30 |

It is obvious from the above results that a photosensitive material having a continuous precoating layer of the thermoplastic resin in accordance with the present invention has a far higher image concentration of the reproductive copy, as compared with one having a continuous precoating layer of a resin outside the scope of this invention, or having no precoating layer. This is illustrative of the fact that a photosensitive material having a continuous precoating layer of the thermoplastic resins specified in the present invention is superior in its acceptance capacity (heat-transfer capacity) of a thermovolatile or sublimable coupler, to photosensitive materials having a continuous precoating layer of resins outside the scope of this invention and, therefore, is very suitable for use in the process for diazotype multi-color reproduction.

We claim:

1. In a process for diazotype multi-color reproduction which comprises

A. exposing image-wise to actinic light a diazotype photosensitive material having a photosensitive layer containing at least one photosensitive diazonium salt (*c*) through an original sheet having opaque image areas and transparent or semi-transparent non-image areas; and B. heating a layer containing at least one thermovolatile or sublimable azo coupler (*a*), which is disposed in face-to-face contact with the photosensitive layer of said photosensitive material, at a preselected area corresponding to an opaque image area of the original sheet desired to be reproduced in a different hue, to thereby heat-transfer said layer of the azo coupler (*a*) to the corresponding position on the surface of said photosensitive layer; said steps (A) and (B) being performed simultaneously or in the time sequence of (A) to (B) or (B) to (A); and C. developing the exposed photosenstive material in the presence of an azo coupler (*b*) having a substantially lower rate of coupling with the diazonium salt (*c*) under the developing condition than that of the azo coupler (*a*), to thereby develop said photosensitive material, whereby in the unexposed latent image area of the portion to which the coupler (*a*) has been heat-transferred, a dye (*c*)–(*a*) having a certain hue or color is formed by the selective reaction of the heat-transferred coupler (*a*) with the diazonium salt (*c*) and at the same time, in the unexposed latent image areas to which the coupler (*a*) has not been heat-transferred, a dye (*c*)–(*b*) having a different hue or color from said dye (*c*)–(*a*) is formed by the reaction of the coupler (*b*) with the diazonium salt (*c*), thus producing a multicolored copied image, the improvement which comprises:

using as said diazotype photosensitive material, that which has a continuous thermoplastic resin layer between a base paper and a photosensitive layer containing at least one photosensitive diazonium salt, in which said thermoplastic resin is selected from at least one of the group consisting of polyvinyl acetate, polyacrylic acid ester, polyvinyl chloride, polyvinylidene chloride, polystyrene, ethylene/vinyl acetate copolymer, styrene/butadiene copolymer and vinyl acetate/acrylic acid copolymer said continuous thermoplastic resin layer having the property that when completely dried it exhibits a water-repellant property uniformly throughout the surface.

2. The process of claim 1, wherein said continuous thermoplastic resin layer is formed by coating the thermoplastic resin in an amount of 1.0 to 30 grams per square meter of the base paper.

3. The process of claim 2, wherein said thermoplastic resin is coated in the form of emulsion or solution.

4. The process of claim 1, wherein said photosensitive layer contains a white, organic or inorganic, solid powder in an amount of from 0.5 to 3 grams per square meter of the photosensitive layer.

5. The process of claim 4, wherein said white inorganic powder is silica, titanium oxide, zinc oxide or alumina.

6. The process of claim 4, wherein said white organic powder is starch, dextrin or cellulose powder.

7. The process of claim 2 wherein said thermoplastic resin is coacted on said base paper in the form of an aqueous emulsion and said coated base paper is heated at a temperature exceeding the softening point of the applied resin.

8. The process of claim 2 wherein said thermoplastic resin is coated on said base film in the form of an organic solvent solution and then at least partially dried.

* * * * *